US009228294B2

(12) United States Patent
Xu et al.

(10) Patent No.: US 9,228,294 B2
(45) Date of Patent: Jan. 5, 2016

(54) ACTIVATOR FOR HYDROGEN PEROXIDE AND ITS APPLICATION

(71) Applicants: Changhai Xu, Wuxi (CN); Chang Sun, Wuxi (CN); Mengze Wang, Wuxi (CN); Jinmei Du, Wuxi (CN); Dong Wei, Wuxi (CN); Shaohai Fu, Wuxi (CN); Weidong Gao, Wuxi (CN)

(72) Inventors: Changhai Xu, Wuxi (CN); Chang Sun, Wuxi (CN); Mengze Wang, Wuxi (CN); Jinmei Du, Wuxi (CN); Dong Wei, Wuxi (CN); Shaohai Fu, Wuxi (CN); Weidong Gao, Wuxi (CN)

(73) Assignee: Jiangnan University, Wuxi, JS (CN)

( * ) Notice: Subject to any disclaimer, the term of this patent is extended or adjusted under 35 U.S.C. 154(b) by 0 days.

(21) Appl. No.: 14/335,929

(22) Filed: Jul. 20, 2014

(65) Prior Publication Data

US 2015/0284900 A1 Oct. 8, 2015

(30) Foreign Application Priority Data

Apr. 2, 2014 (CN) ..... 2014 1 0132200

(51) Int. Cl.

| | |
|---|---|
| ***C11D 3/28*** | (2006.01) |
| ***C11D 3/39*** | (2006.01) |
| ***C11D 3/395*** | (2006.01) |
| ***C11D 7/54*** | (2006.01) |
| ***D06L 3/02*** | (2006.01) |
| ***C11D 7/32*** | (2006.01) |
| ***C11D 11/00*** | (2006.01) |

(52) U.S. Cl.

CPC . *D06L 3/021* (2013.01); *C11D 3/28* (2013.01); *C11D 3/392* (2013.01); *C11D 7/3281* (2013.01); *C11D 11/0017* (2013.01)

(58) Field of Classification Search

CPC ..... C11D 3/28; C11D 3/392; C11D 7/328; C11D 11/00171; C07D 213/04; D06L 3/021

USPC ..... 510/500; 8/111, 137

See application file for complete search history.

(56) References Cited

U.S. PATENT DOCUMENTS 6,197,737 B1 * 3/2001 Willey ..... C07D 223/10 510/302

* cited by examiner

*Primary Examiner* — Gregory R Delcotto

(74) *Attorney, Agent, or Firm* — Lili Chen

(57) ABSTRACT

The present invention provides a novel, non-toxic and eco-friendly hydrogen peroxide activator, a method for its production and its application. The activator can effectively activate $H_2O_2$ under mild conditions, such as low temperature and nearly neutral aqueous solution, making it a more advantageous alternative to traditional activators. The novel activator can further expand the application of $H_2O_2$ in the fields, such as textile, paper making and health care.

13 Claims, 1 Drawing Sheet

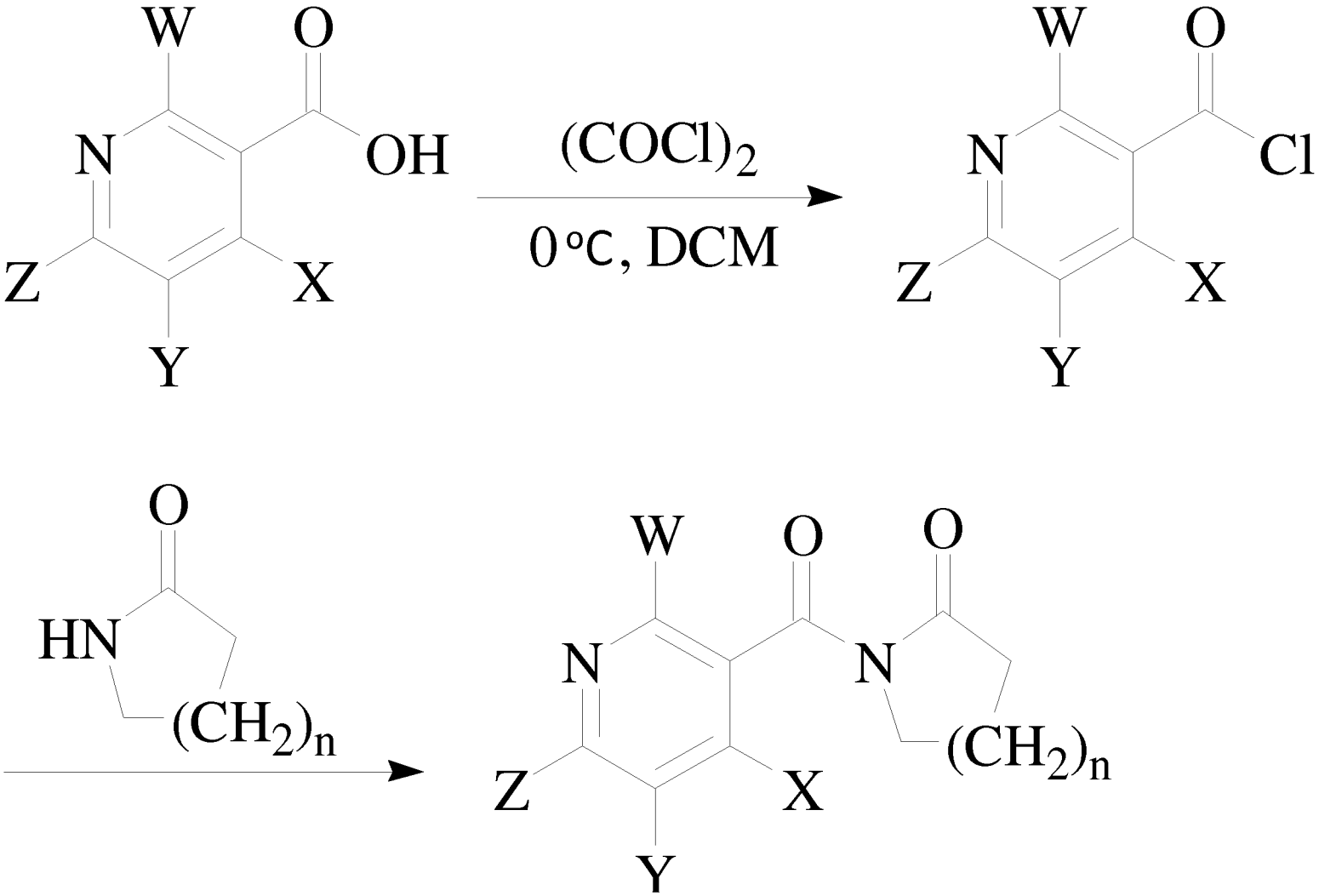
O
OH
W
X
N
Y
Z
$(COCl)_2$
0 °C, DCM
O
Cl
W
X
N
Y
Z
O
HN
$(CH_2)_n$
O
N
$(CH_2)_n$
O
W
X
N
Y
Z

ACTIVATOR FOR HYDROGEN PEROXIDE AND ITS APPLICATION

CROSS-REFERENCES AND RELATED APPLICATIONS

This application claims the benefit of priority to Chinese Application No. 201410132200.2, entitled "A novel activator for hydrogen peroxide and its application", filed Apr. 2, 2014, which is herein incorporated by reference in its entirety.

BACKGROUND OF THE INVENTION

1. Field of the Invention

The present invention relates to the field of fine chemicals, and more particularly relates to a novel activator for hydrogen peroxide and its application.

2. Description of the Related Art

Hydrogen peroxide ($H_2O_2$) can be electrolyzed in water to generate $H^+$ and $HOO^-$ which has strong oxidability. It is well known that the ionization constant of $H_2O_2$ is $1.78\times10^{-12}$ and $H_2O_2$ is hard to ionize at room temperature (20° C.) to generate enough oxidizing $HOO^-$. Thus, in order to produce enough $HOO^-$, $H_2O_2$ is usually ionized under high temperature (100° C.) or strong alkaline condition (pH11-12) during practical application. However, both high temperature and strong alkaline reaction system are energy-consuming and environment-damaging. In addition, harsh conditions may cause serious damage to the matrix. There is a need in developing a novel, environmental friendly and effective activator for $H_2O_2$.

$H_2O_2$ and peroxide activator can react in water to generate peracid. The reaction is called peroxide hydrolysis reaction. Compared with hydrogen peroxide, peracid has stronger oxidability at low temperature. Niacin, which is also known as vitamin B3 and vitamin PP is one of the 13 essential vitamins. Niacin is non-toxic and harmless. In this invention, we provided a new synthetic $H_2O_2$ activator based on niacin or niacin derivatives.

DETAILED DESCRIPTION

The goal of the present invention is to provide a novel activator for hydrogen peroxide, a method for its synthesis, and application of the activator.

The structural formula of the activator is (Formula I)

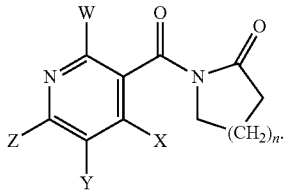

In Formula I, n=1-5, the substituent W is hydrogen, alkyl, aryl, alkoxy, hydroxy, nitro, amino, halogen, mercapto, cyano or trifluoromethyl; the substituent X is hydrogen, alkyl, aryl, alkoxy, hydroxy, nitro, amino, halogen, mercapto, cyano or trifluoromethyl; the substituent Y is hydrogen, alkyl, aryl, alkoxy, hydroxy, nitro, amino, halogen, mercapto, cyano or trifluoromethyl; the substituent Z is hydrogen, alkyl, aryl, alkoxy, hydroxy, nitro, amino, halogen, mercapto, cyano or trifluoromethyl.

The active group of the $H_2O_2$ activator is imide group. $H_2O_2$ and the activator reacted to generate lactam and peroxy acid which has strong oxidizing ability.

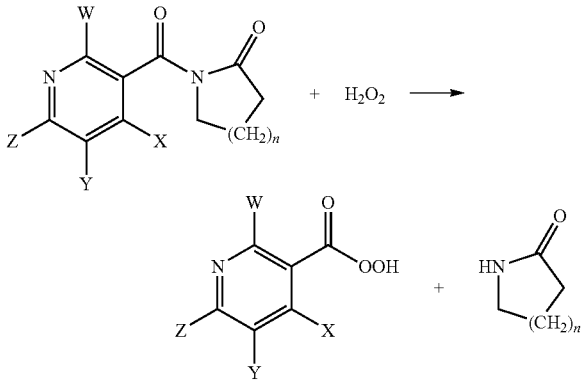

Preference is given to the activator with structural formula II.

Preference is also given to the activator with structural formula III.

Preference is also given to the activator with structural formula IV.

Preference is also given to the activator with structural formula V.

Preference is also given to the activator with structural formula VI.

(Formula II)

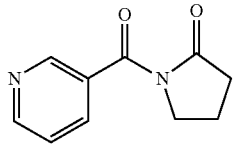

(Formula III)

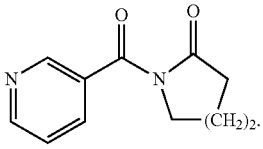

(Formula IV)

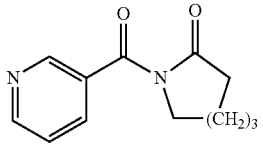

(Formula V)

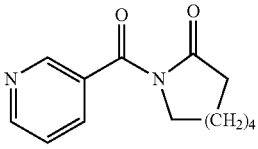

(Formula VI)

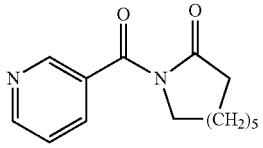

The present invention provides a method of producing a novel activator for hydrogen peroxide. The method comprises the following steps: (1) synthesizing Nicotinoyl-chloride or Nicotinoyl-chloride derivatives by acyl chlorination of niacin or niacin derivatives; (2) synthesizing the activator by reacting Nicotinoyl-chloride or Nicotinoyl-chloride derivatives with lactam.

In one embodiment, oxalyl chloride (Chemical Formula: $(COCl)_2$) is used to react with niacin and derivatives to synthesize nicotinnoyl-chloride and derivatives in the acyl chlorination reaction (FIG. 1). The reaction condition is as follows: the molar ratio of niacin or niacin derivatives to oxalyl chloride is 1:1-1:2.5; the reaction temperature is between 0° C. to solvent reflux temperature (a temperature at which the solvent begins to reflux, for example, 110° C.).; the reaction is catalyzed by N,N-dimethylformamide and proceeds for 2-24 hours under the protection of an inert gas.

In another embodiment, the substrates (i.e. niacin and derivatives and oxalyl chloride) are dissolved in toluene, tetrahydrofuran, acetonitrile, methylene chloride or ethyl acetate at a concentration of 0.5 M.

In a preferred embodiment of the step (2), the mole ratio of nicotinoyl-chloride or nicotinoyl-chloride derivatives to lactam is 1:1-1:2 and the reaction performs at room temperature to solvent reflux temperature; the reaction lasts 3-24 hours with the protection of an inert gas. The lactam can be chosen from butyrolactam, valerolactam, hexanolactam, oenantholactam and caprylolactam.

In another preferred embodiment of the step (2), the substrates were dissolved in toluene, tetrahydrofuran, acetonitrile, methylene chloride or ethyl acetate at a concentration of 0.5 M.

In another preferred embodiment of the step (2), the products were washed with toluene, tetrahydrofuran, acetone, ethyl acetate, acetonitrile or methanol or a combination of two or more above solvents.

The present invention provides a method of applying the activator of hydrogen peroxide to bleach fine cotton fabric. 2 gram of cotton fabric was bleached in a mixture containing 30 mL of sodium dihydrogen phosphate/disodium hydrogen phosphate buffer (pH 7.2), 36 mmol/L hydrogen peroxide solution (30%, w/v), 0.5 g/L EDTA, 0.5 g/L SDBS (Sodium dodecyl benzene sulfonate) and 30 mmol/L the activator of hydrogen peroxide at 50° C. for 30 min.

This invention provides a simple and easy method for producing a novel, non-toxic and eco-friendly activator for hydrogen peroxide. Compared to traditional activators, the hydrogen peroxide activators of the invention can effectively activate $H_2O_2$ under mild conditions, such as relatively low temperature and nearly neutral aqueous solution. The final product of the activation reaction is non-toxic and friendly to the environment. The usage of the novel hydrogen peroxide activator can alleviate to some degree the damage to environment caused by the toxic final products generated by traditional activators, and further expand the application of hydrogen peroxide in the fields such as textile, paper making and health care.

BRIEF DESCRIPTION OF DRAWINGS

FIG. 1. The synthesis process of the activator for hydrogen peroxide.

EXAMPLES

Materials and Methods

The formulas of the activators are identified by NMR (Nuclear magnetic resonance) and Mass Spectra.

Example 1

Synthesis Process of the Activator with Structural Formula II 5 mmol of niacin and 10 mmol of oxalyl chloride were dissolved in dichloromethane. The acyl chlorination reaction was catalyzed by N,N-dimethylformamide and proceeded in a three-neck flask connected to a drying tube at 0° C. for 1 hour and room temperature for another 3 hour with the protection of argon.

The solvents were removed by rotary evaporation. 6 mmol of butyrolactam and 12 mL of dichloromethane were added into the three-neck flask. The reaction was allowed to proceed at room temperature for 3 hours with the protection of argon.

The solvents were removed by rotary evaporation. The white solid left was collected and washed with hexane. After vacuum filtration and drying, 0.69 g of pure activator was obtained and then analyzed by NMR (Nuclear magnetic resonance) and Mass Spectra. The results are as follows: $^1$H NMR (400 MHz, $CDCl_3$) δ 8.80 (d, J=1.7 Hz, 1H), 8.71 (dd, J=4.9, 1.6 Hz, 1H), 7.88 (dt, J=7.9, 1.9 Hz, 1H), 7.37-7.33 (m, 1H), 3.98 (t, J=7.1 Hz, 2H), 2.63 (t, J=8.0 Hz, 2H), 2.21-2.12 (m, 2H). $^{13}$C NMR (101 MHz, $CDCl_3$) δ 174.79, 168.57, 152.25, 149.79, 136.59, 130.57, 122.79, 46.46, 33.32, 17.69. It is confirmed by calculation that the MS-ESI (m/z) and structural formula of the compound is $C_{10}H_{11}N_2O_2[M+H]^+$ 191.0 and Formula II, respectively.

Example 2

Synthesis Process of the Activator with Structural Formula III 5 mmol niacin and 10 mmol oxalyl chloride were dissolved in dichloromethane. The acyl chlorination reaction was catalyzed by N,N-dimethylformamide in a three-neck flask connected to a drying tube. The reaction proceeded at 0° C. for 1 hour and room temperature for another 3 hours with the protection of argon.

The solvents were removed by rotary evaporation. 6 mmol of valerolactam and 12 mL of dichloromethane were added into the three-neck flask. The reaction was allowed to proceed at room temperature for 3 hours with the protection of argon.

The solvents were removed by rotary evaporation. The white solid left was collected and washed with hexane. After vacuum filtration and drying, 0.73 g of pure activator was obtained and then analyzed by NMR (Nuclear magnetic resonance) and Mass Spectra. The results are as follows: $^1$H NMR (400 MHz, $CDCl_3$) δ 8.71 (d, J=1.6 Hz, 1H), 8.67 (dd, J=4.9, 1.6 Hz, 1H), 7.83 (dt, 1H), 7.34 (ddd, J=7.9, 4.9, 0.6 Hz, 1H), 3.83 (t, J=5.9 Hz, 2H), 2.58 (t, J=6.4 Hz, 2H), 2.04-1.91 (m, 4H). $^{13}$C NMR (101 MHz, $CDCl_3$) δ 173.68, 172.51, 151.72, 148.68, 135.49, 132.51, 123.22, 46.19, 34.77, 22.85, 21.44. It is confirmed by calculation that the MS-ESI (m/z) and structural formula of the compound is $C_{11}H_{13}N_2O_2$ $[M+H]^+$ 205.0 and Formula III, respectively.

Example 3

Synthesis Process of the Activator with Structural Formula IV 5 mmol niacin and 10 mmol oxalyl chloride were dissolved in dichloromethane. The acyl chlorination reaction was catalyzed by N,N-dimethylformamide in a three-neck flask connected to a drying tube. The reaction proceeded at 0° C. for 1 hour and room temperature for another 3 hours with the protection of argon.

The solvents were removed by rotary evaporation. 6 mmol of hexanolactam and 12 mL of dichloromethane were added into the three-neck flask. And then the reaction was allowed to proceed at room temperature for 3 hours with the protection of argon.

The solvents were removed by rotary evaporation. The white solid left was collected and washed with hexane. After vacuum filtration and drying, 0.70 g of pure activator was obtained and the analyzed by NMR (Nuclear magnetic resonance) and Mass Spectra. The results are as follows: $^1$H NMR (400 MHz, $CDCl_3$) δ 8.71 (d, J=1.9 Hz, 1H), 8.67 (dd, J=4.9, 1.6 Hz, 1H), 7.82 (dt, J=7.9, 1.9 Hz, 1H), 7.34 (dd, J=7.9, 4.9 Hz, 1H), 4.00 (d, J=5.2 Hz, 2H), 2.74-2.69 (m, 2H), 1.85 (s, 6H). $^{13}$C NMR (101 MHz, $CDCl_3$) δ 177.80, 172.03, 151.70, 148.53, 135.33, 132.90, 123.20, 45.13, 38.93, 29.65, 29.35, 23.90. It is confirmed by calculation that the MS-ESI (m/z) and structural formula of the compound is $C_{12}H_{15}N_2O_2[M+H]^+$ 219.0 and Formula IV, respectively.

Example 4

Synthesis Process of the Activator with Structural Formula V 5 mmol niacin and 10 mmol oxalyl chloride were dissolved in dichloromethane. The acyl chlorination reaction was catalyzed by N,N-dimethylformamide in a three-neck flask connected to a drying tube. The reaction proceeded at 0° C. for 1 hour and room temperature for another 3 hours with the protection of argon.

The solvents were removed by rotary evaporation. 6 mmol of oenantholactam and 12 mL of dichloromethane were added into the three-neck flask. The reaction was allowed to proceed at room temperature for 3 hours with the protection of argon.

The solvents were removed by rotary evaporation. The white solid left was collected and washed with hexane. After vacuum filtration and drying, 0.85 g of pure activator was obtained and then analyzed by NMR (Nuclear magnetic resonance) and Mass Spectra. The results are as follows: $^1$H NMR (400 MHz, $CDCl_3$) δ 8.69 (d, J=1.7 Hz, 1H), 8.66 (dd, J=4.9, 1.6 Hz, 1H), 7.82 (dt, 1H), 7.36-7.31 (m, 1H), 4.03 (t, 2H), 2.72-2.66 (m, 2H), 1.96-1.86 (m, 4H), 1.71-1.52 (m, 4H). $^{13}$C NMR (101 MHz, $CDCl_3$) δ 179.04, 172.10, 151.44, 148.52, 135.41, 132.82, 123.21, 44.89, 36.03, 30.52, 29.21, 26.34, 23.94. It is confirmed by calculation that the MS-ESI (m/z) and structural formula of the compound is $C_{13}H_{17}N_2O_2[M+H]^+$ 233.0 and Formula V, respectively.

Example 5

Synthesis Process of the Activator with Structural Formula VI 5 mmol of niacin and 10 mmol of oxalyl chloride were dissolved in dichloromethane. The acyl chlorination reaction was catalyzed by N,N-dimethylformamide in three-neck flask connected to a drying tube. The reaction proceeded at 0° C. for 1 hour and room temperature for another 3 hours with the protection of argon.

The solvents were removed by rotary evaporation. 6 mmol of caprylolactam and 12 mL of dichloromethane were added into the three-neck flask. The reaction was allowed to proceed at room temperature for 3 hours with the protection of argon.

The solvents were removed by rotary evaporation. The white solid left was collected and washed with hexane. After vacuum filtration and drying, 0.89 g of pure activator was obtained and analyzed by NMR (Nuclear magnetic resonance) and Mass Spectra. The results are as follows: $^1$H NMR (400 MHz, $CDCl_3$) δ 8.72 (d, J=1.6 Hz, 1H), 8.69 (dd, J=4.9, 1.6 Hz, 1H), 7.85 (dt, 1H), 7.37-7.33 (m, 1H), 4.01 (t, 2H), 2.51-2.46 (m, 2H), 1.95-1.81 (m, 4H), 1.69-1.60 (m, 2H), 1.55-1.41 (m, 4H). $^{13}$C NMR (101 MHz, $CDCl_3$) δ 181.67, 171.19, 152.01, 148.78, 135.58, 132.67, 123.48, 46.55, 39.76, 28.00, 27.87, 26.18, 25.52, 21.15. It is confirmed by calculation that the MS-ESI (m/z) and structural formula of the compound is $C_{14}H_{19}N_2O_2$ $[M+H]^+$ 246.0 and Formula VI, respectively.

Example 6

Cotton Fabric Bleaching Using the Hydrogen Peroxide Activators 2 gram of fine cotton fabric was treated with a mixture containing 30 mL of sodium dihydrogen phosphate/disodium hydrogen phosphate buffer (pH 7.2), 36 mmol/L of hydrogen peroxide solution (30%, w/v), 0.5 g/L EDTA, 0.5 g/L SDBS (Sodium dodecyl benzene sulfonate) and 30 mmol/L one of the hydrogen peroxide activators at 50° C. for 30 min. The cotton fabric of the control group was treated in a mixture with any hydrogen peroxide activator. Formulas of Activator 2, Activator 3, Activator 4 and Activator 5 used in the treatment are compound III, IV, V and VI, respectively. The whiteness of the fine cotton fabric treated with different hydrogen peroxide activators is shown in table 1.

TABLE 1

Whiteness of cotton fabric treated with $H_2O_2$ and different activators

| | Cotton fabric sample | | | | |
|---|---|---|---|---|---|
| | Control | Activator 2 | Activator 3 | Activator 4 | Activator 5 |
| CIE whiteness | 21.58 | 53.40 | 52.35 | 52.95 | 54.55 |

While the present invention has been described in some detail for purposes of clarity and understanding, one skilled in the art will appreciate that various changes in form and detail can be made without departing from the true scope of the invention. All figures, tables, appendices, patents, patent applications and publications, referred to above, are hereby incorporated by reference.

What is claimed is:

1. A hydrogen peroxide activator, wherein the structural formula of said activator is (Formula I)

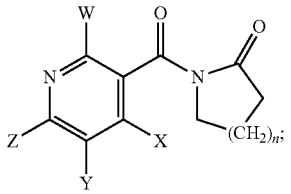

wherein n is 3-5, the substituent W is hydrogen, alkyl, aryl, alkoxy, hydroxy, nitro, amino, halogen, mercapto, cyano or trifluoromethyl; the substituent X is hydrogen, alkyl, aryl, alkoxy, hydroxy, nitro, amino, halogen, mercapto, cyano or trifluoromethyl; the substituent Y is hydrogen, alkyl, aryl, alkoxy, hydroxy, nitro, amino, halogen, mercapto, cyano or trifluoromethyl; and the substituent Z is hydrogen, alkyl, aryl, alkoxy, hydroxy, nitro, amino, halogen, mercapto, cyano or trifluoromethyl.

2. The activator of claim 1, wherein said structural formula is Formula IV:

(Formula IV)

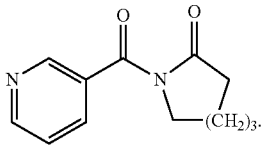

3. The activator of claim 1, wherein said structural formula is Formula V:

(Formula V)

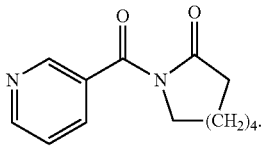

4. The activator of claim 1, wherein said structural formula is Formula VI:

(Formula VI)

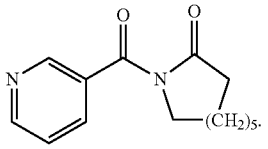

5. A method of producing the activator of claim 1, comprising the steps of:

1) Synthesizing nicotinoyl-chloride or nicotinoyl-chloride derivatives by acyl chlorination of niacin or niacin derivatives;

2) Synthesizing the activator by reacting said nicotinoyl-chloride or nicotinoyl-chloride derivatives with lactam.

6. The method of claim 5, wherein said Nicotinoyl-chloride or Nicotinoyl-chloride derivatives are synthesized by acyl chlorination of niacin or niacin derivatives and oxalyl chloride, wherein the mole ratio of niacin or niacin derivatives to oxalyl chloride is 1:1-1:2.5; the reaction is catalyzed by N,N-dimethylformamide and proceeds for 2-24 hours with the protection of an inert gas at a temperature from 0° C. to solvent reflux temperature.

7. The method of claim 6, wherein niacin/niacin derivatives and oxalyl chloride are dissolved in toluene, tetrahydrofuran, acetonitrile, methylene chloride or ethyl acetate.

8. The method of claim 5, wherein the molar ratio of said nicotinoyl-chloride or nicotinoyl-chloride derivatives to lactam is 1:1-1:2 in step 2), and nicotinoyl-chloride or nicotinoyl-chloride derivatives react with lactam under a temperature between room temperature and solvent reflux temperature for 3-24 hours with the protection of an inert gas.

9. The method of claim 5, wherein said lactam is hexanolactam, oenantholactam or caprylolactam.

10. The method of claim 5, wherein nicotinoyl-chloride or nicotinoyl-chloride derivatives and lactam are dissolved in toluene, tetrahydrofuran, acetonitrile, methylene chloride or ethyl acetate in step 2).

11. The method of claim 5, further comprising washing the activator with one or more solvents selected from the group consisting of toluene, tetrahydrofuran, acetone, ethyl acetate, acetonitrile and methanol.

12. A method of using the activator of claim 1 for bleaching fine cotton fabric, comprising treating the fine cotton fabric with the activator of claim 1 and hydrogen peroxide.

13. A method of claim 12, comprises treating 2 gram of cotton fabric with a mixture containing 30 mL of sodium dihydrogen phosphate/disodium hydrogen phosphate buffer (pH 7.2), 36 mmol/L of hydrogen peroxide solution 30%, w/v, 0.5 g/L of ethylene diamine tetraacetate, 0.5 g/L of sodium dodecyl benzene sulfonate and 30 mmol/L of the activator of claim 1 at 50° C. for 30 min.

* * * * *